US008573193B2

(12) United States Patent
Khoshnood

(10) Patent No.: US 8,573,193 B2
(45) Date of Patent: Nov. 5, 2013

(54) BOW STABILIZING SYSTEMS AND METHODS

(76) Inventor: Bahram Khoshnood, Cumming, GA (US)

( * ) Notice: Subject to any disclaimer, the term of this patent is extended or adjusted under 35 U.S.C. 154(b) by 371 days.

(21) Appl. No.: 12/983,919

(22) Filed: Jan. 4, 2011

(65) Prior Publication Data

US 2012/0125309 A1 May 24, 2012

Related U.S. Application Data

(63) Continuation-in-part of application No. 12/950,995, filed on Nov. 19, 2010.

(51) Int. Cl.
*F41B 5/20* (2006.01)
*F41B 5/14* (2006.01)

(52) U.S. Cl.
CPC ..... *F41B 5/1426* (2013.01)
USPC ..... 124/89; 124/86; 124/88

(58) Field of Classification Search
CPC ..... F41B 5/1426
USPC ..... 124/86, 88, 89
See application file for complete search history.

(56) References Cited

U.S. PATENT DOCUMENTS 3,342,172 A * 9/1967 Sanders ..... 124/23.1
3,412,725 A * 11/1968 Hoyt, Jr ..... 124/84
3,670,712 A * 6/1972 Izuta ..... 124/89
4,005,858 A * 2/1977 Lochner ..... 267/136
4,085,832 A * 4/1978 Gaines et al. ..... 188/268
4,570,608 A * 2/1986 Masterfield ..... 124/89
4,893,606 A * 1/1990 Sisko ..... 124/89
5,016,602 A * 5/1991 Mizek ..... 124/89
5,273,022 A * 12/1993 Leven ..... 124/89
5,339,793 A * 8/1994 Findley ..... 124/89
5,370,104 A * 12/1994 Neie ..... 124/89
5,388,563 A * 2/1995 Hsu ..... 124/23.1
5,411,009 A * 5/1995 Thompson et al. ..... 124/89
5,513,622 A * 5/1996 Musacchia, Sr. ..... 124/89
5,613,484 A * 3/1997 Troncoso ..... 124/89
5,657,741 A * 8/1997 Todd ..... 124/89
5,735,257 A * 4/1998 Walk ..... 124/89
5,992,403 A * 11/1999 Slates ..... 124/89
6,085,736 A * 7/2000 Osterhues ..... 124/89
6,105,564 A * 8/2000 Suppan ..... 124/23.1
6,179,510 B1 * 1/2001 Meicke et al. ..... 403/306
6,298,842 B1 * 10/2001 Sims ..... 124/89
6,382,201 B1 * 5/2002 McPherson et al. ..... 124/89
6,526,957 B1 * 3/2003 Leven ..... 124/89
6,588,414 B2 * 7/2003 McMillan, III ..... 124/89
6,675,793 B1 * 1/2004 Saunders ..... 124/89
6,712,059 B2 * 3/2004 Donovan ..... 124/89
6,718,964 B1 * 4/2004 Graf ..... 124/89

(Continued)

*Primary Examiner* — Gene Kim
*Assistant Examiner* — Alexander Niconovich
(74) *Attorney, Agent, or Firm* — Brient Intellectual Property Law, LLC

(57) ABSTRACT

A bow stabilizing and shock dampening assembly that, in various embodiments, comprises: (1) one or more dampener supports; (2) a support structure for supporting the one or more dampener supports; and (3) an attachment mechanism that is adapted for selectively attaching the bow stabilizing and shock dampening assembly to a bow. In particular embodiments, the support structure extends between the dampener support and the attachment mechanism, and each dampener support is adapted to maintain a respective dampener in a plane that is at least substantially parallel to a central axis of the bow stabilizing and shock dampening assembly.

26 Claims, 21 Drawing Sheets

(56) References Cited

U.S. PATENT DOCUMENTS

| | | | | |
|---|---|---|---|---|
| 6,817,352 | B1 * | 11/2004 | Saunders | 124/89 |
| 7,290,644 | B2 * | 11/2007 | Miyake | 188/379 |
| 7,793,645 | B2 * | 9/2010 | Walk et al. | 124/89 |
| 7,954,481 | B2 * | 6/2011 | Barnard | 124/88 |
| 8,038,133 | B2 * | 10/2011 | McPherson | 267/140.4 |
| 8,141,548 | B2 * | 3/2012 | Leven | 124/89 |
| 8,166,963 | B2 * | 5/2012 | Leven | 124/89 |
| 8,225,778 | B2 * | 7/2012 | Walk et al. | 124/89 |
| 2003/0226556 | A1 * | 12/2003 | Leven | 124/89 |
| 2006/0180135 | A1 * | 8/2006 | Andrews | 124/89 |
| 2006/0283435 | A1 * | 12/2006 | Pellerite | 124/89 |

* cited by examiner

BOW STABILIZING SYSTEMS AND METHODS

CROSS-REFERENCE TO RELATED APPLICATIONS

This application is a continuation-in-part of U.S. patent application Ser. No. 12/950,995 entitled "Bow Stabilizing and Shock Dampening Systems and Methods", which was filed on Nov. 19, 2010, and which is hereby incorporated herein by reference in its entirety.

BACKGROUND

Bow stabilizers are used to help hold an archer's bow steady throughout the shot cycle. A typical current bow stabilizer is simply a piece of metal (or other weight) that is attached to the front of a bow. Although such stabilizers can be useful in reducing rotation in the bow through the shot cycle, there is currently a need for improved stabilizers that are adapted for: (1) further reducing rotation in the bow through the shot cycle; (2) reducing torque on the archer's grip through the shot cycle; (3) dampening vibration; and/or (4) reducing the noise generated during the shot cycle.

SUMMARY

A bow stabilizing and shock dampening assembly according to a particular embodiment comprises: (1) a dampener support; (2) a support structure that is adapted for supporting the dampener support; and (3) an attachment mechanism that is adapted for selectively attaching the bow stabilizing and shock dampening assembly to a bow. In particular embodiments, the support structure extends between the dampener support and the attachment mechanism, and the dampener support is adapted to maintain a dampener (e.g., a substantially planar dampener) in a plane that is at least substantially parallel to a central axis of the bow stabilizing and shock dampening assembly.

In various embodiments, the bow stabilizing and shock dampening assembly comprises: (1) a first dampener support that is adapted to maintain a first dampener in a first plane; (2) a second dampener support that is adapted to maintain a second dampener in a second plane; (3) a third dampener support that is adapted to maintain a third dampener in a third plane; (4) an attachment mechanism that is adapted for attaching the bow stabilizing and dampening assembly to a bow; and (5) a support structure that is adapted for maintaining the first, second, and third dampener supports in a substantially fixed relationship relative to each other while the bow stabilizer is in use. In particular embodiments, a line of intersection between the first and second planes is substantially parallel to: (A) a line of intersection between the second and third planes; and (B) a line of intersection between the first and third planes.

A weapon stabilizing and shock dampening assembly according to certain embodiments comprises: (1) a first dampener support that is adapted to maintain a first dampener in a first plane; (2) a second dampener support, disposed adjacent the first dampener support, that is adapted to maintain a second dampener in a second plane, wherein the first and second planes are not parallel or approximately parallel to each other; and (2) a fastening mechanism, which may be disposed adjacent the first and second dampener supports, that is adapted for selectively fastening the weapon stabilizing and shock dampening assembly to a weapon. For purposes of this disclosure two planes are considered parallel to each other if, for example: (1) the planes are co-planar; or (2) the planes are spaced apart from each other and are parallel to each other.

BRIEF DESCRIPTION OF THE DRAWINGS

Figure 1:
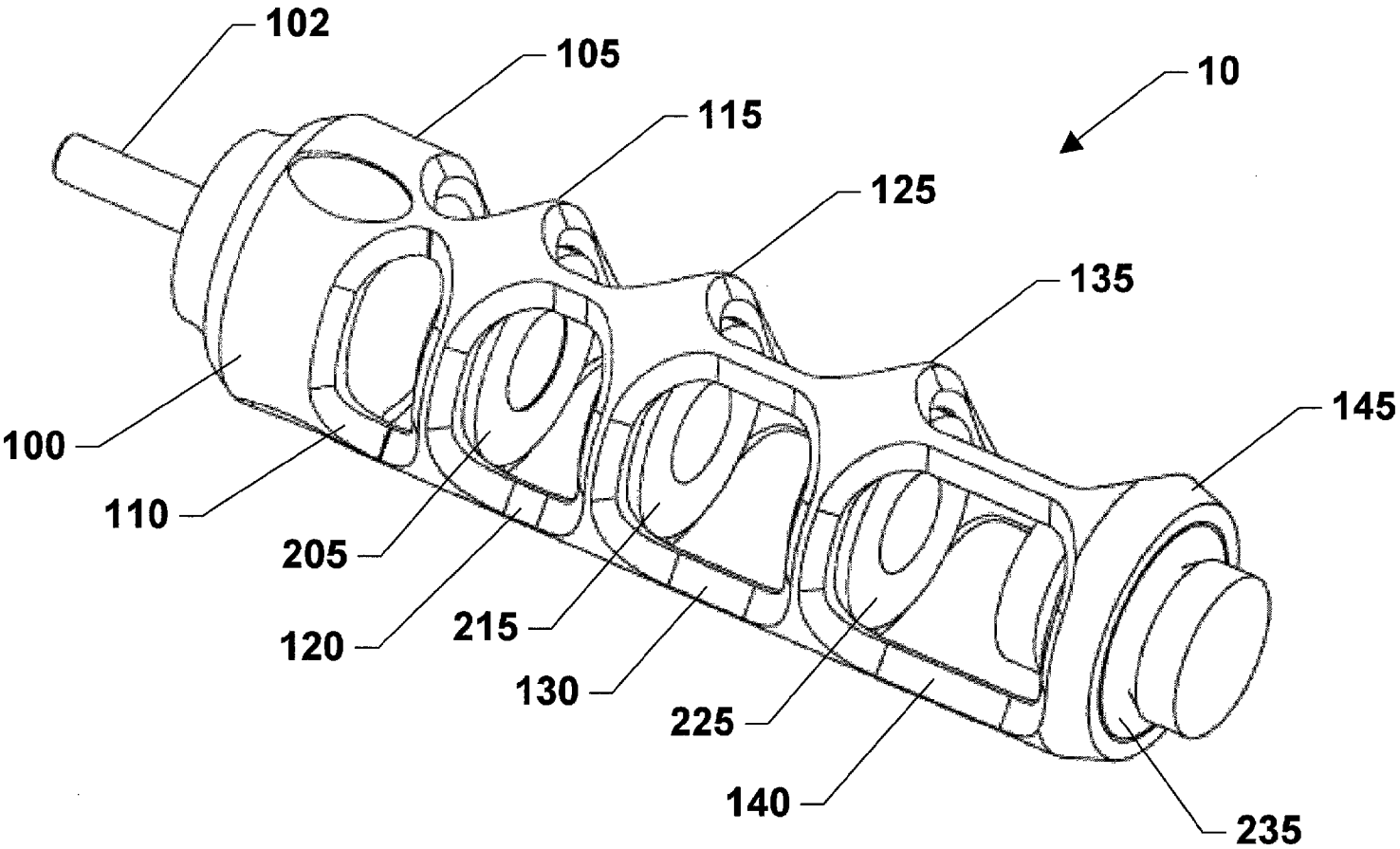
Figure 2:
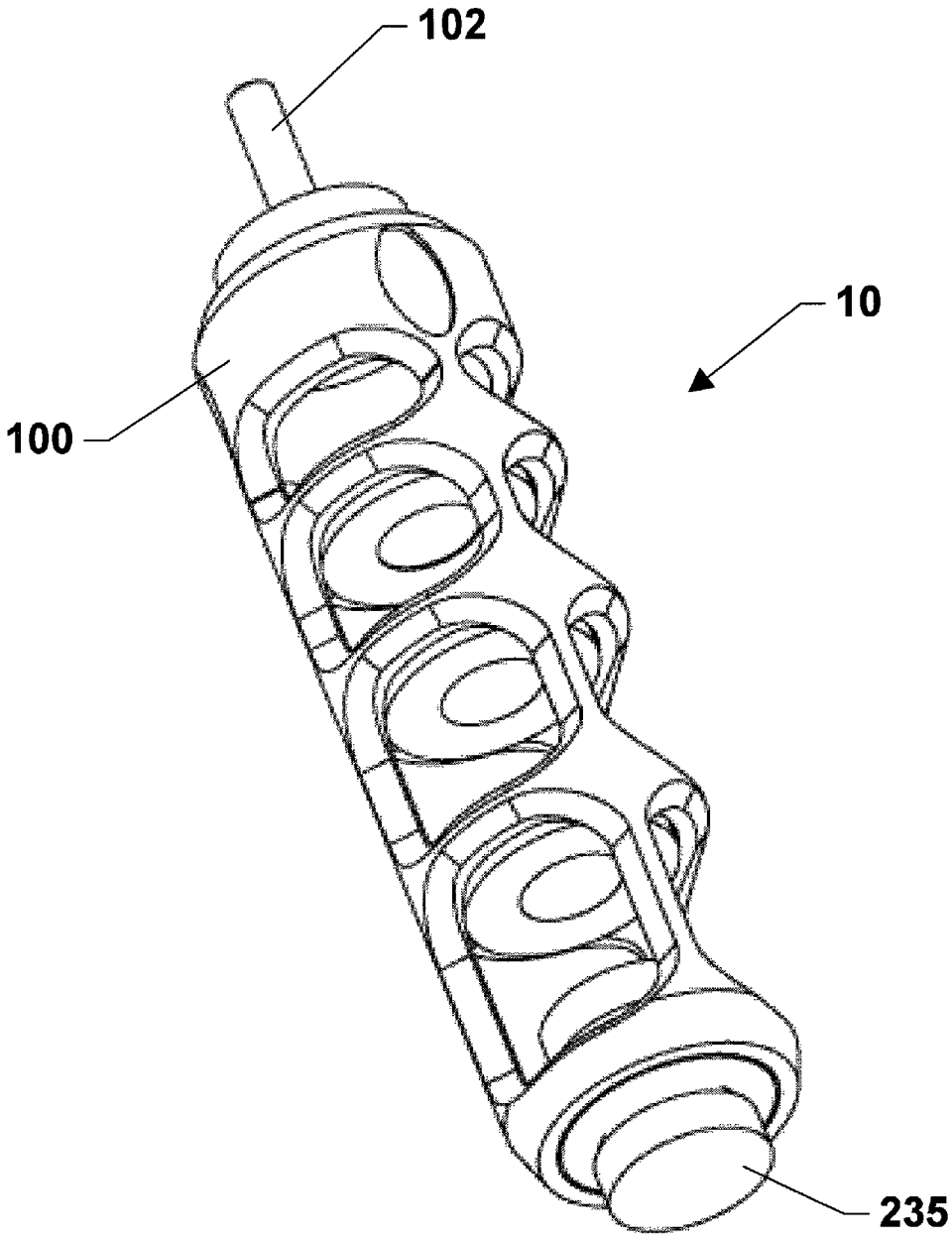
Figure 3:
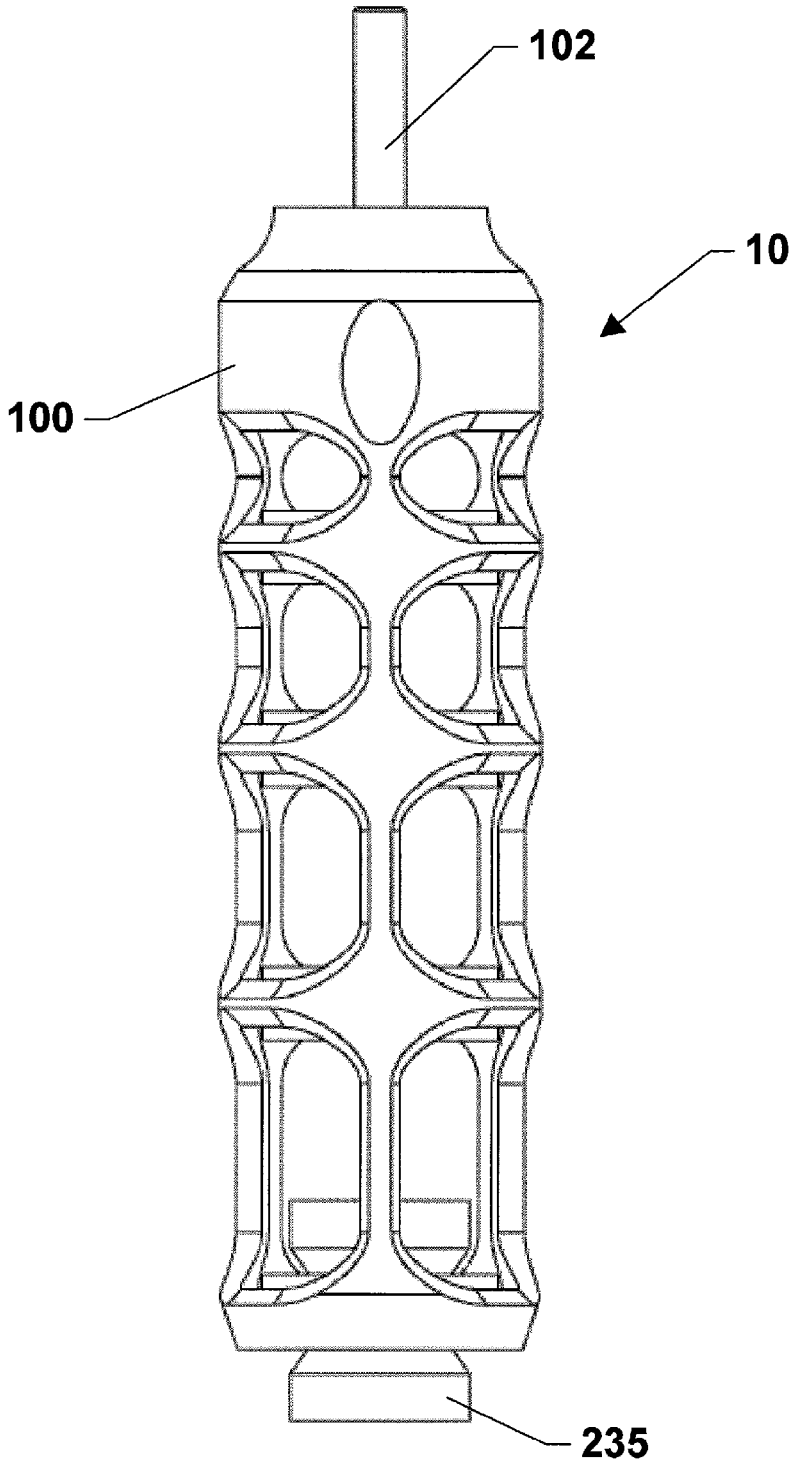
Figure 4:
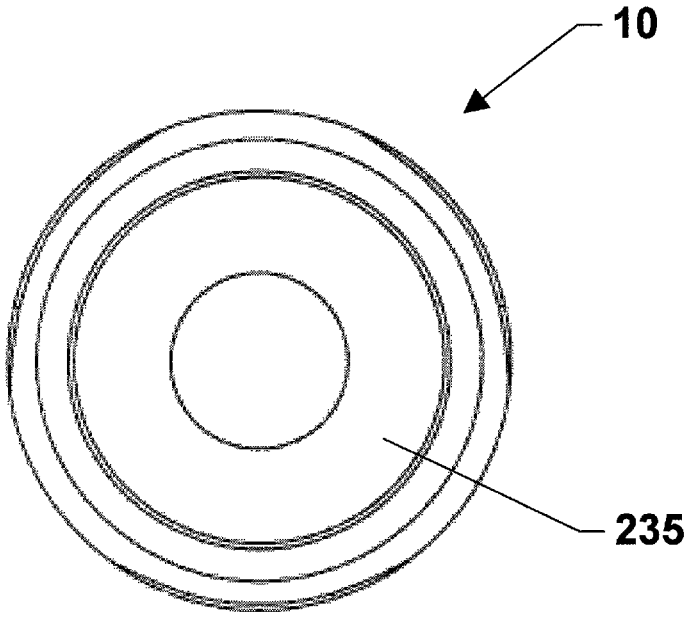
Figure 5:
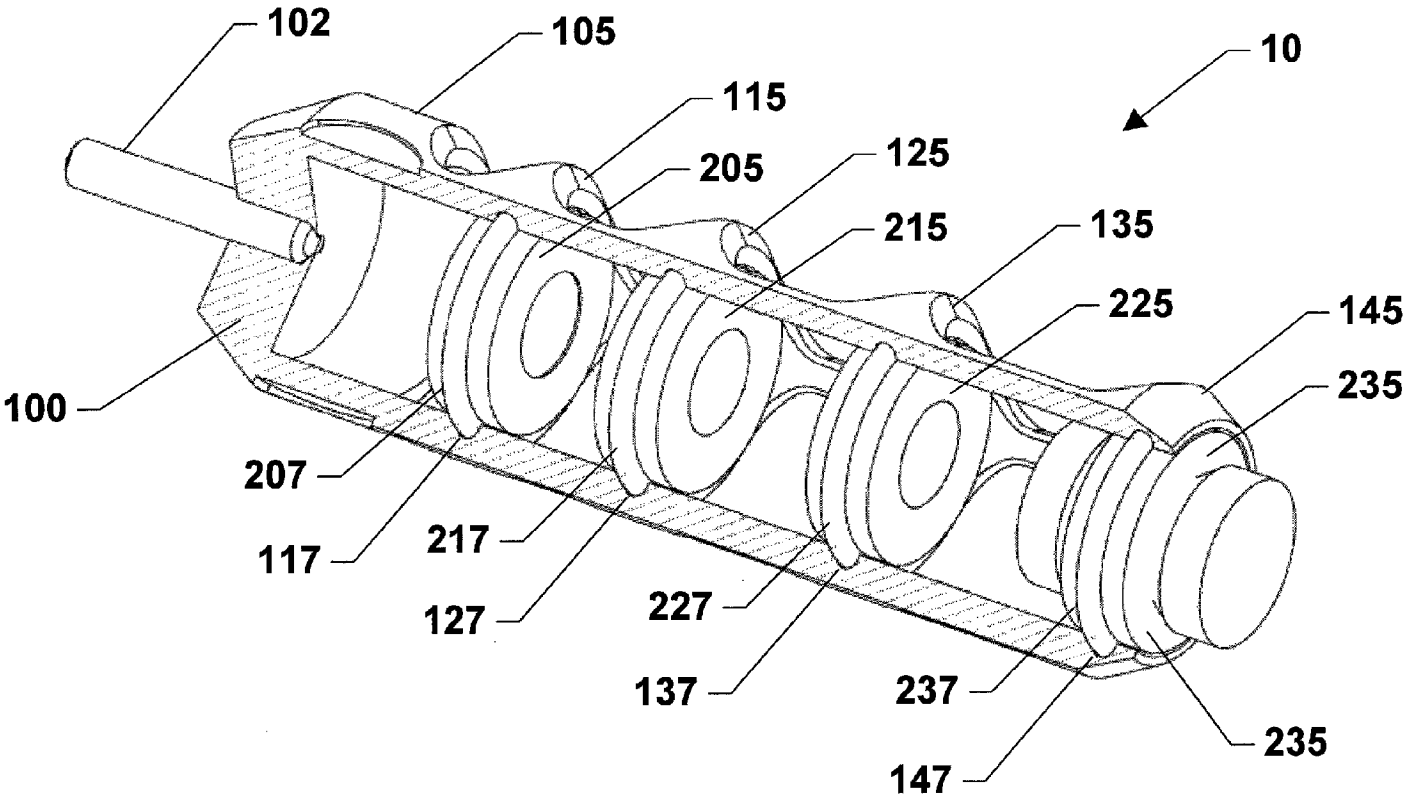
Figure 6:
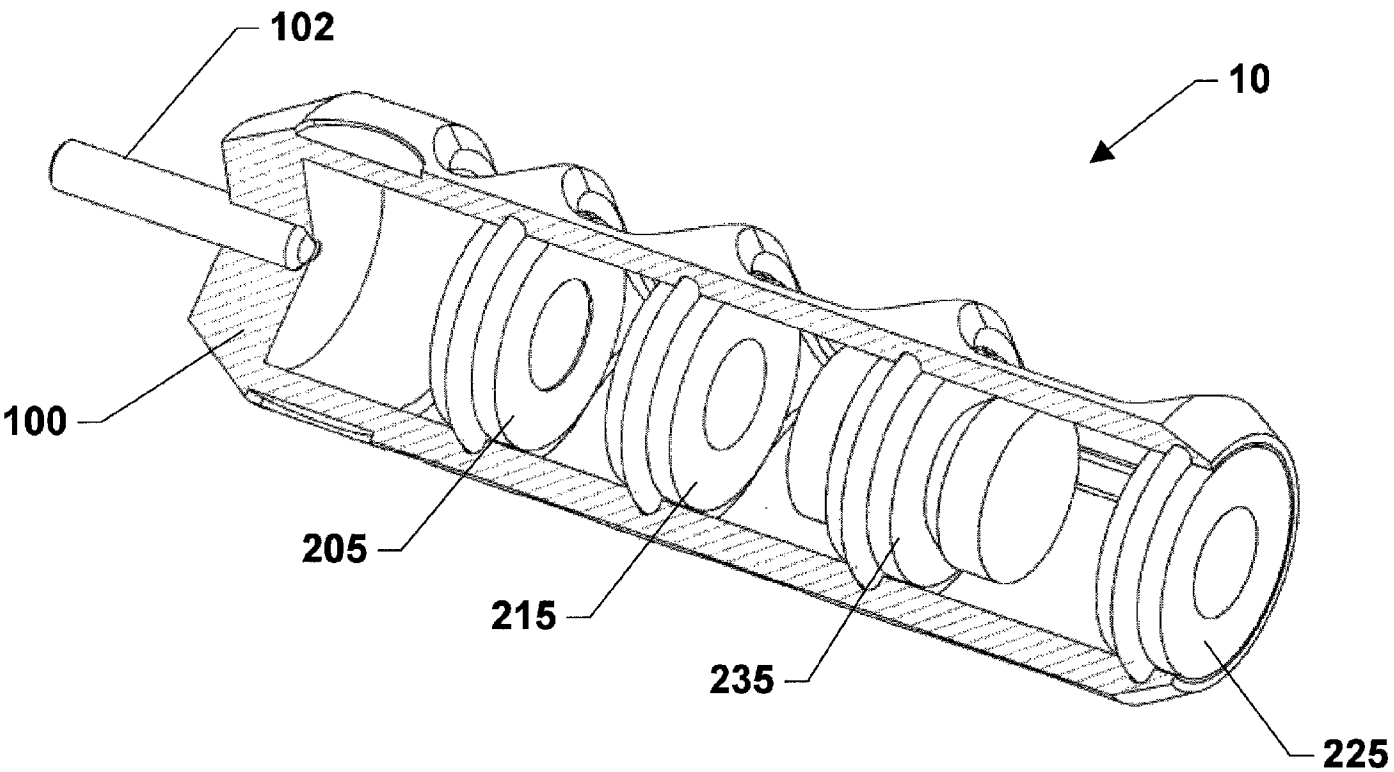
Figure 7C:
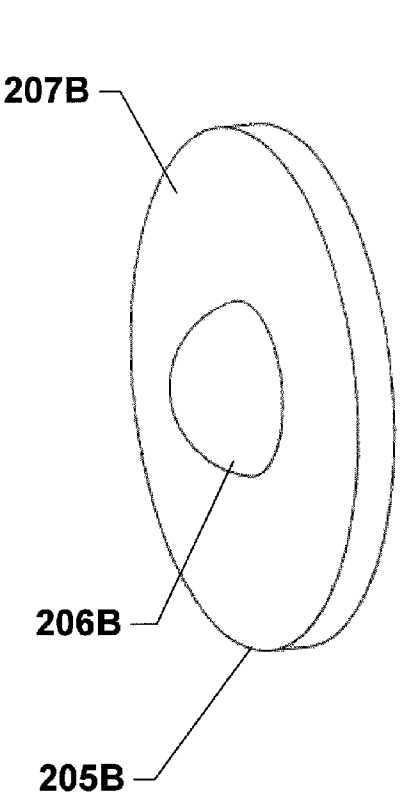
Figure 7B:
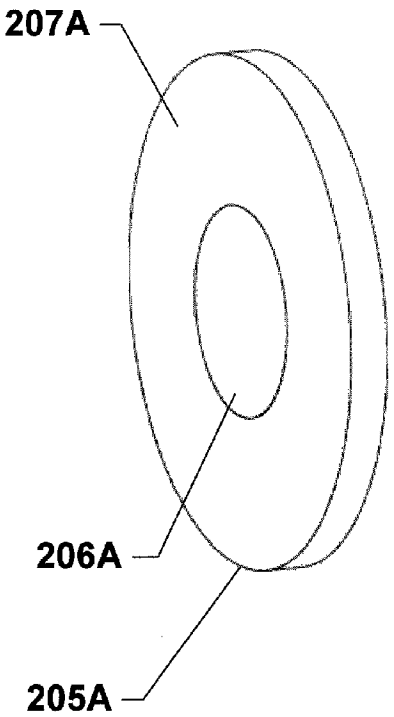
Figure 7A:
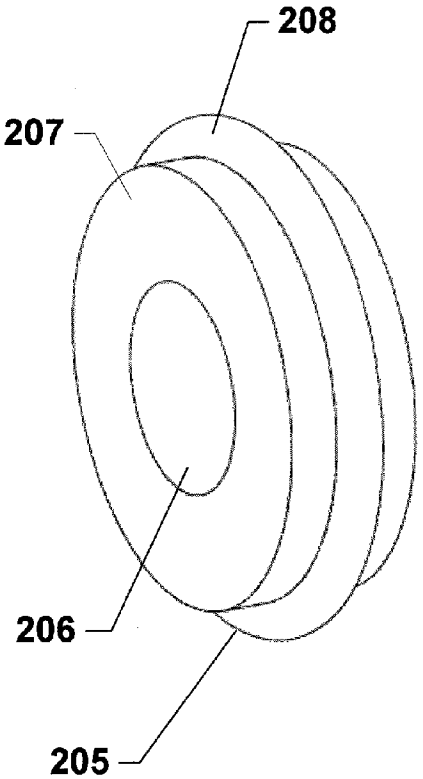
Figure 8:
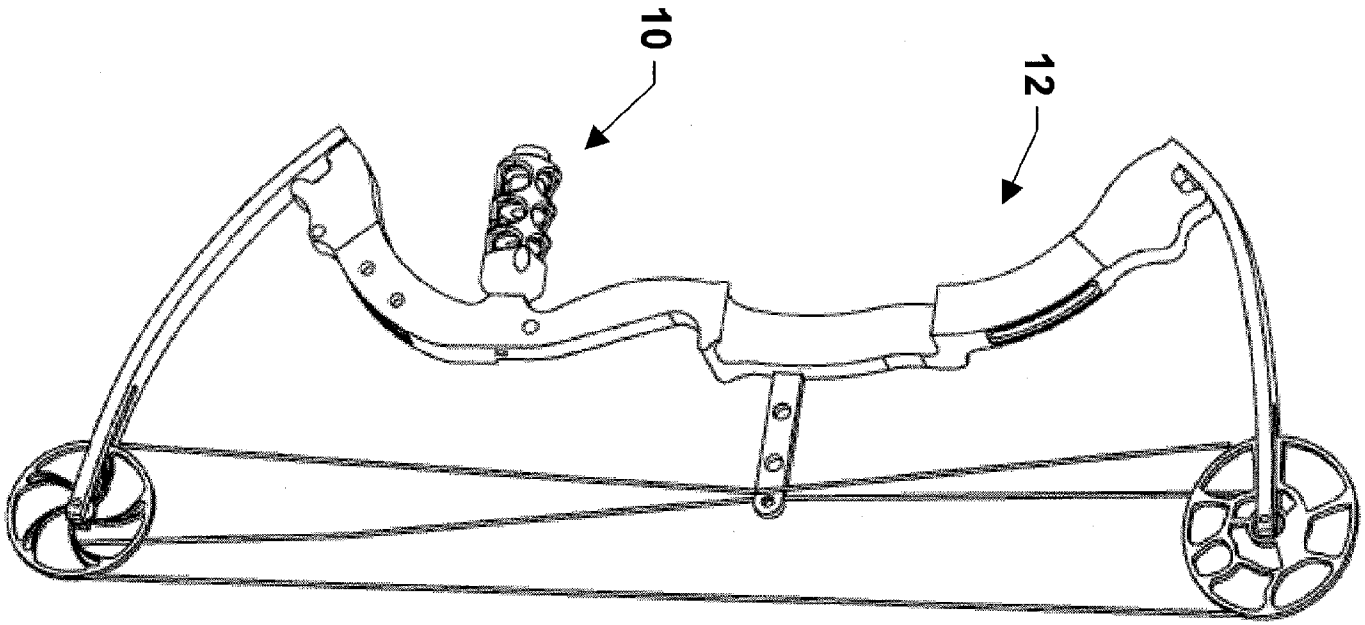
Figure 9:
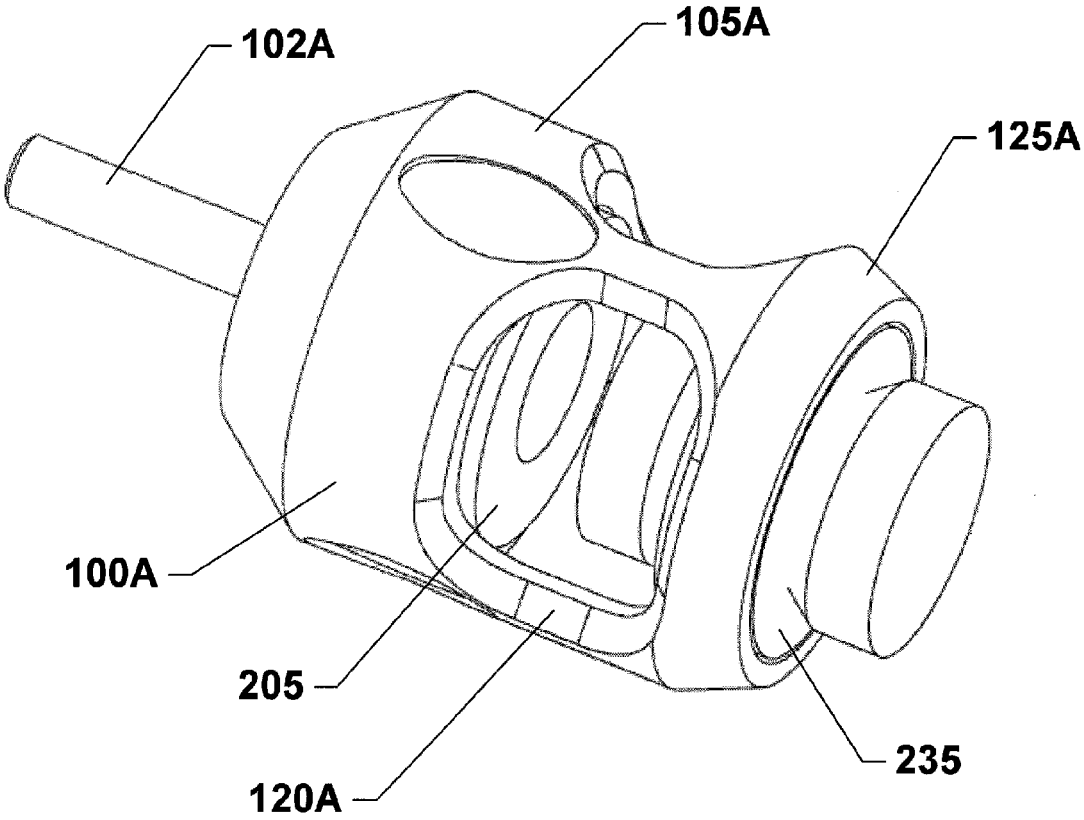
Figure 10:
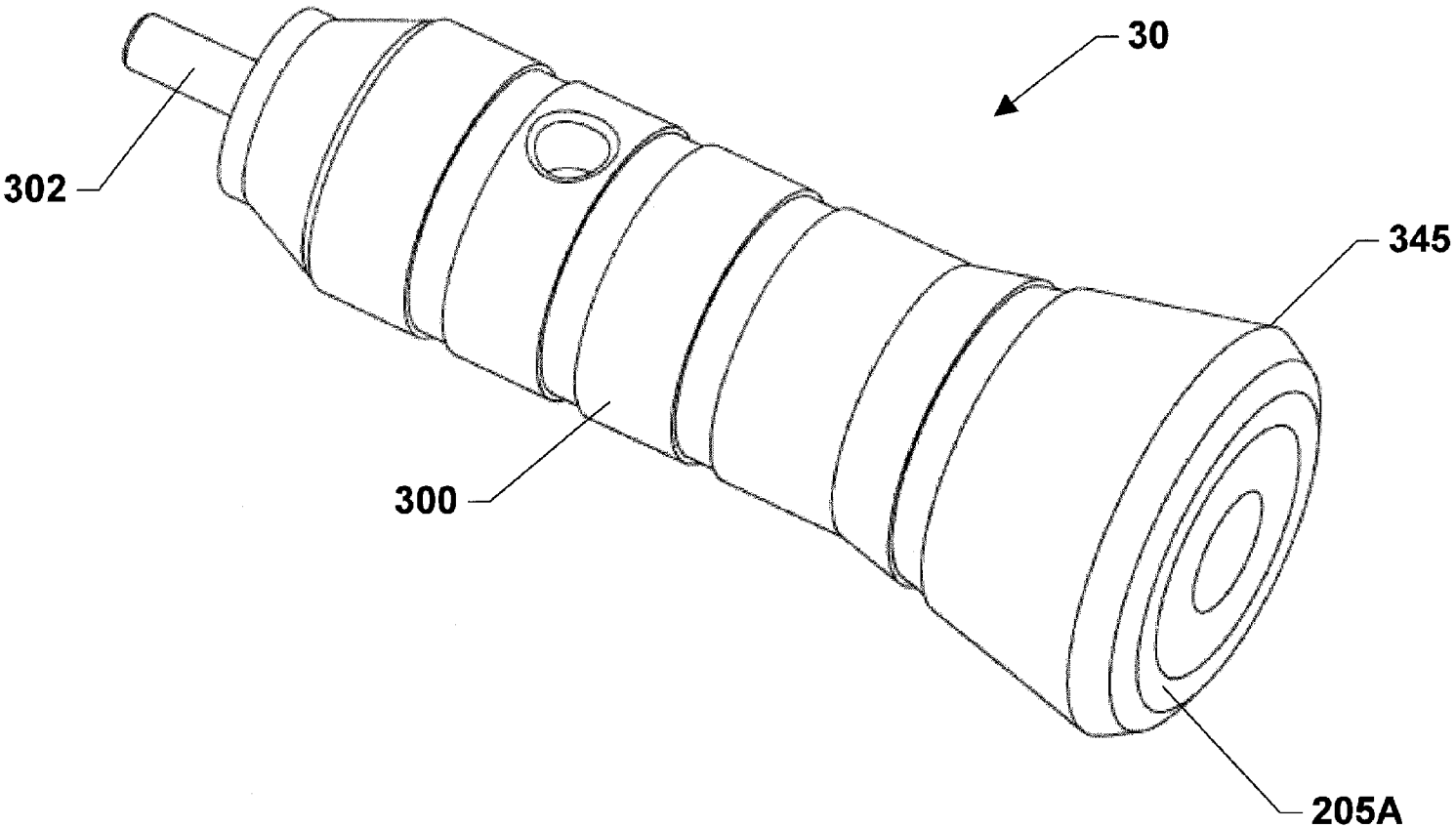
Figure 11:
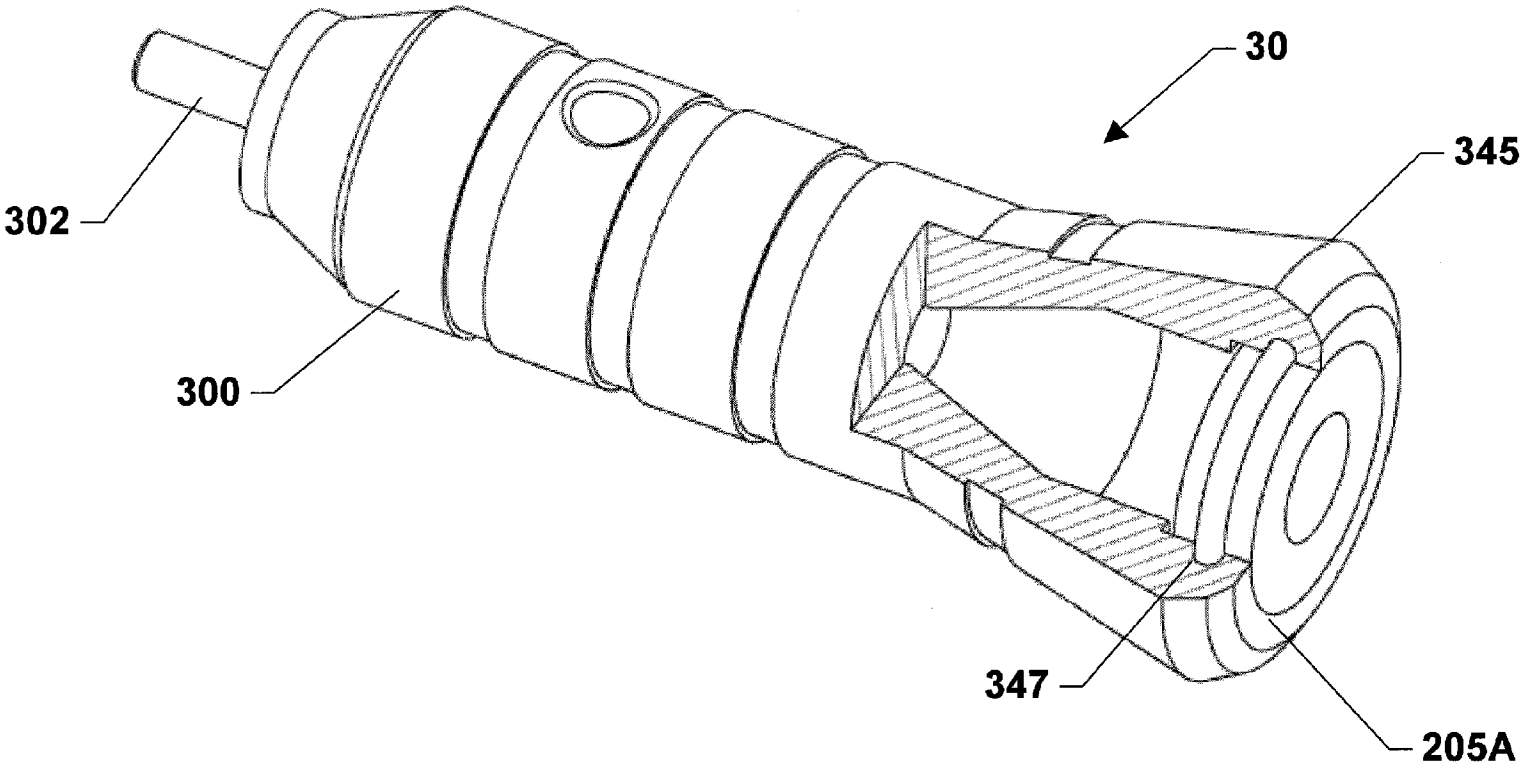
Figure 12:
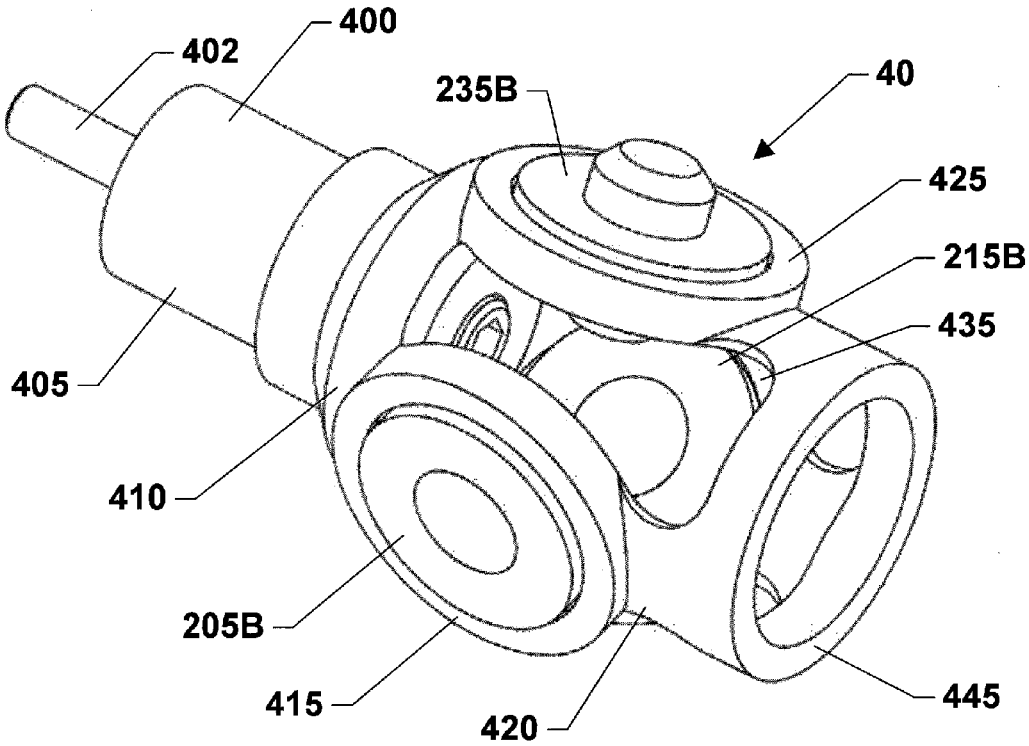
Figure 13:
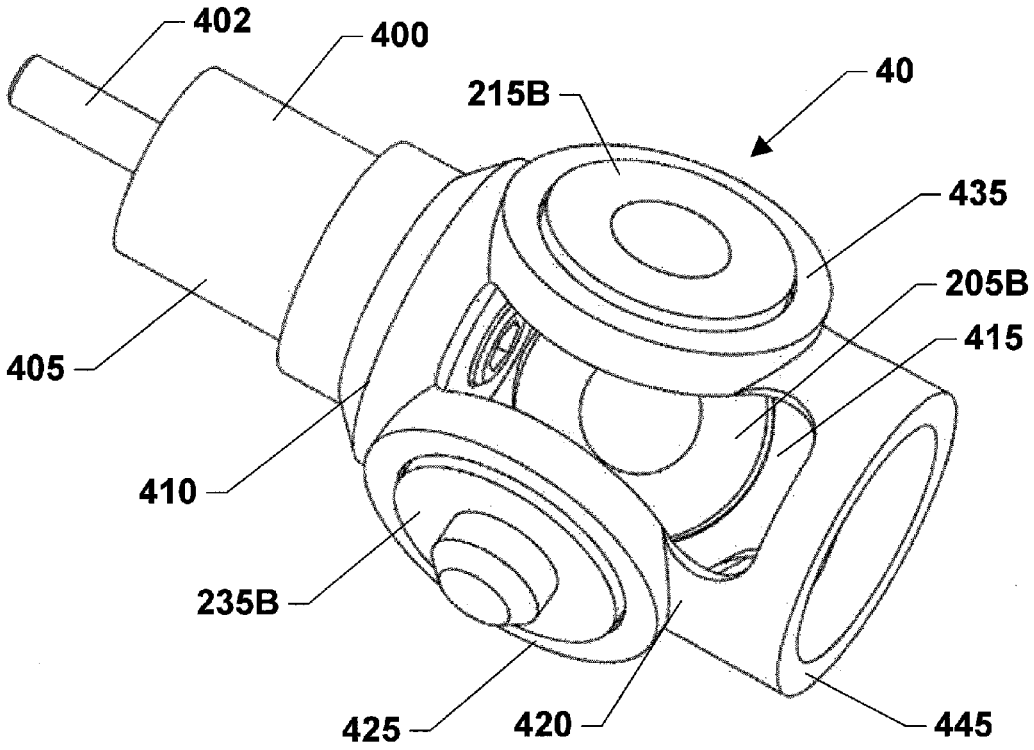
Figure 14:
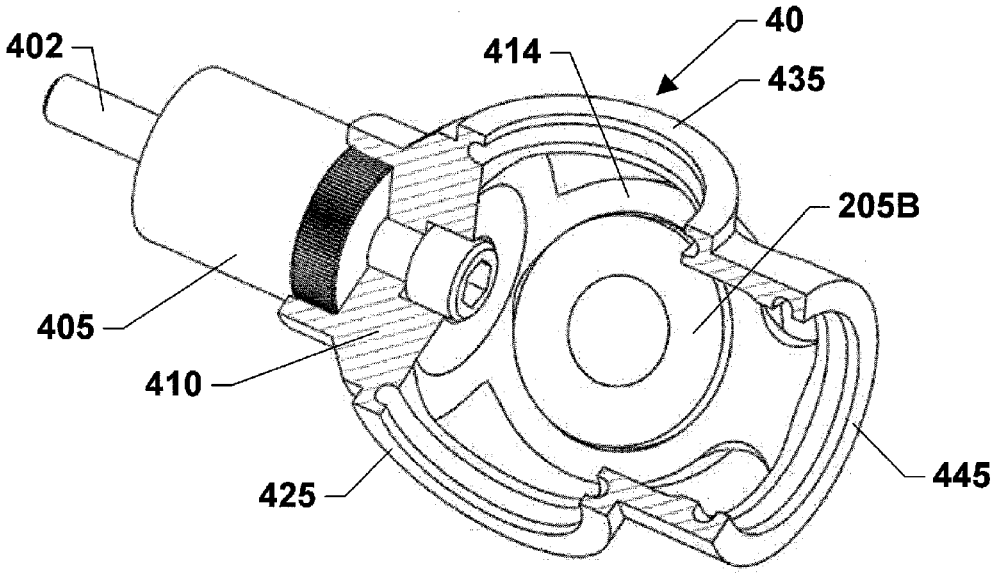
Figure 15:
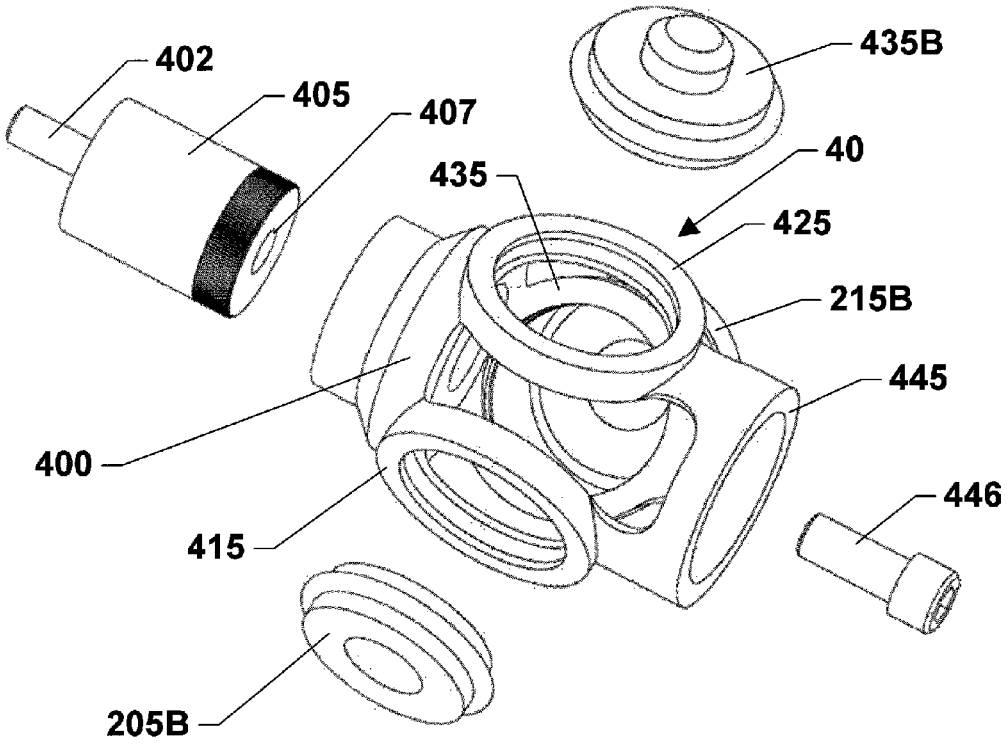
Figure 16:
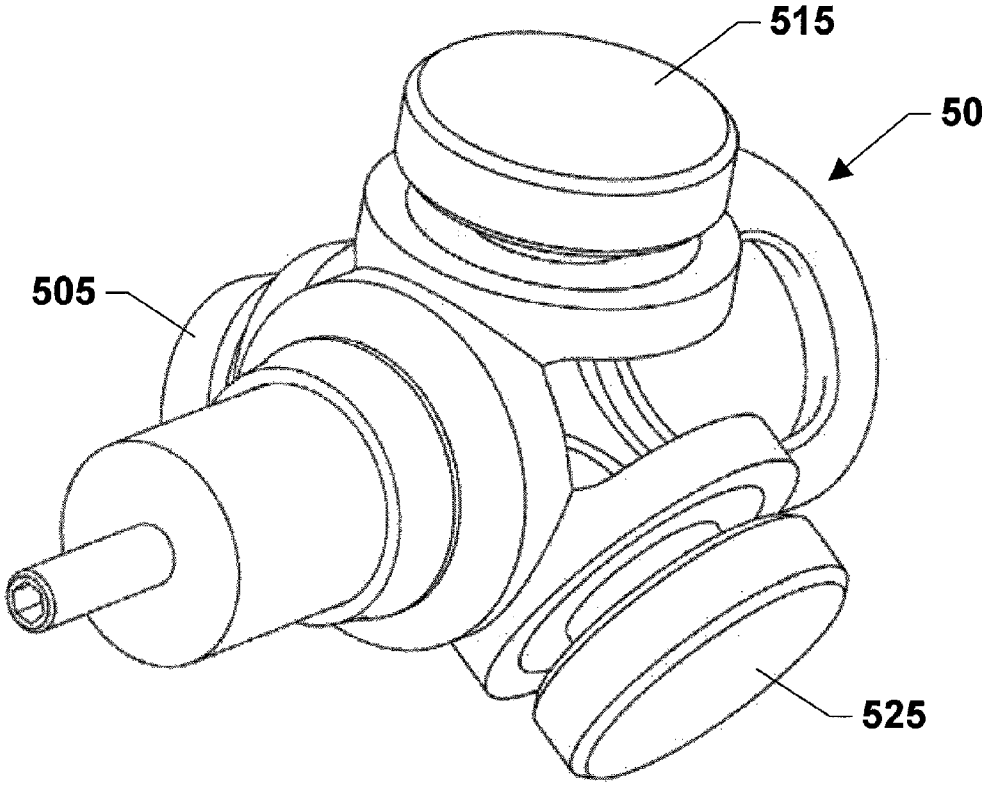
Figure 17:
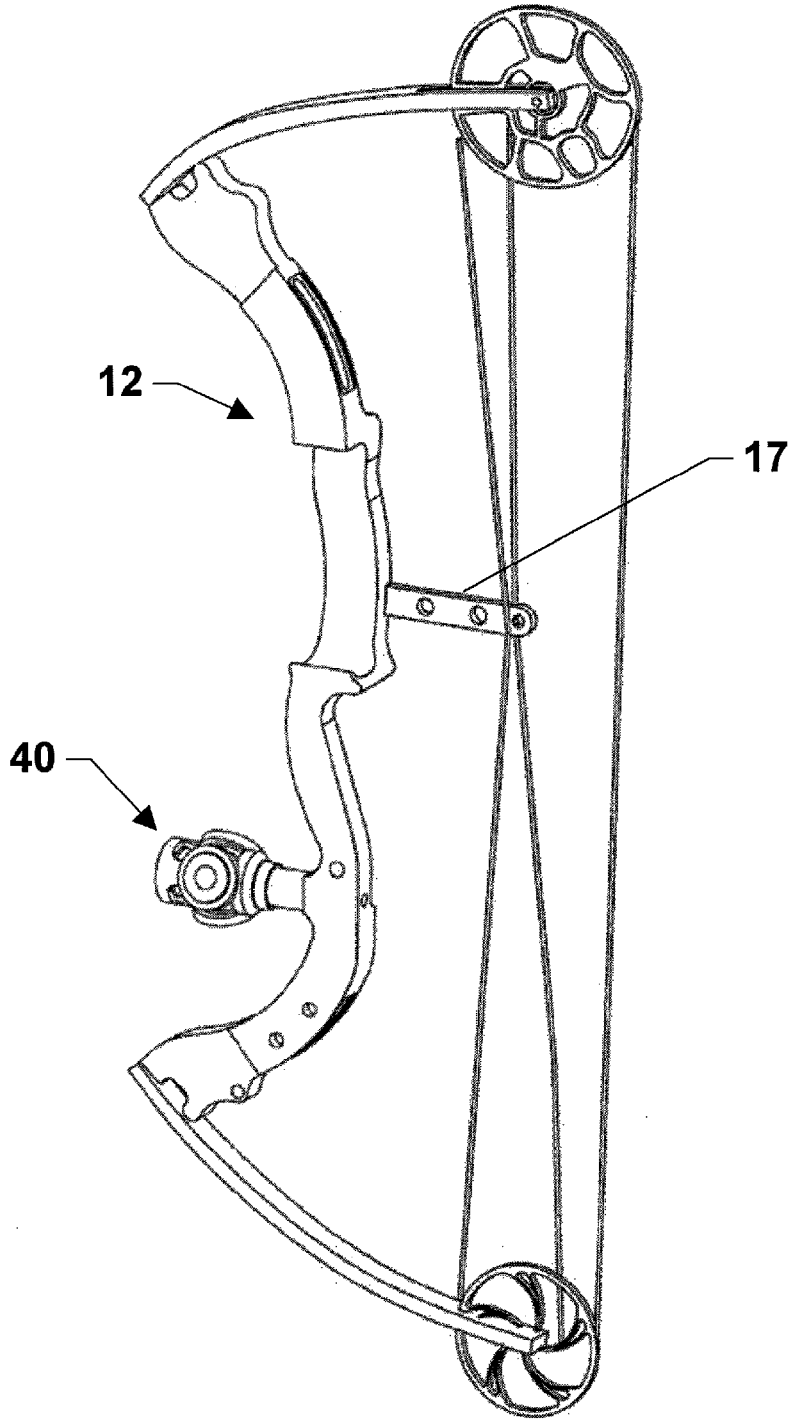
Figure 18:
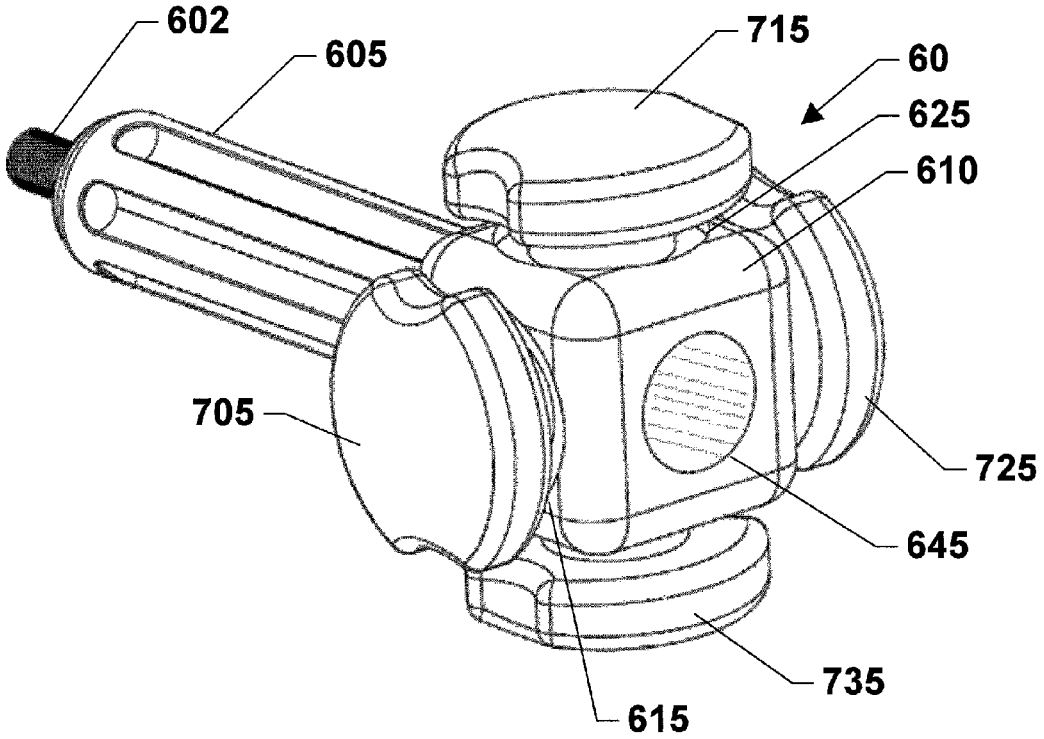
Figure 19:
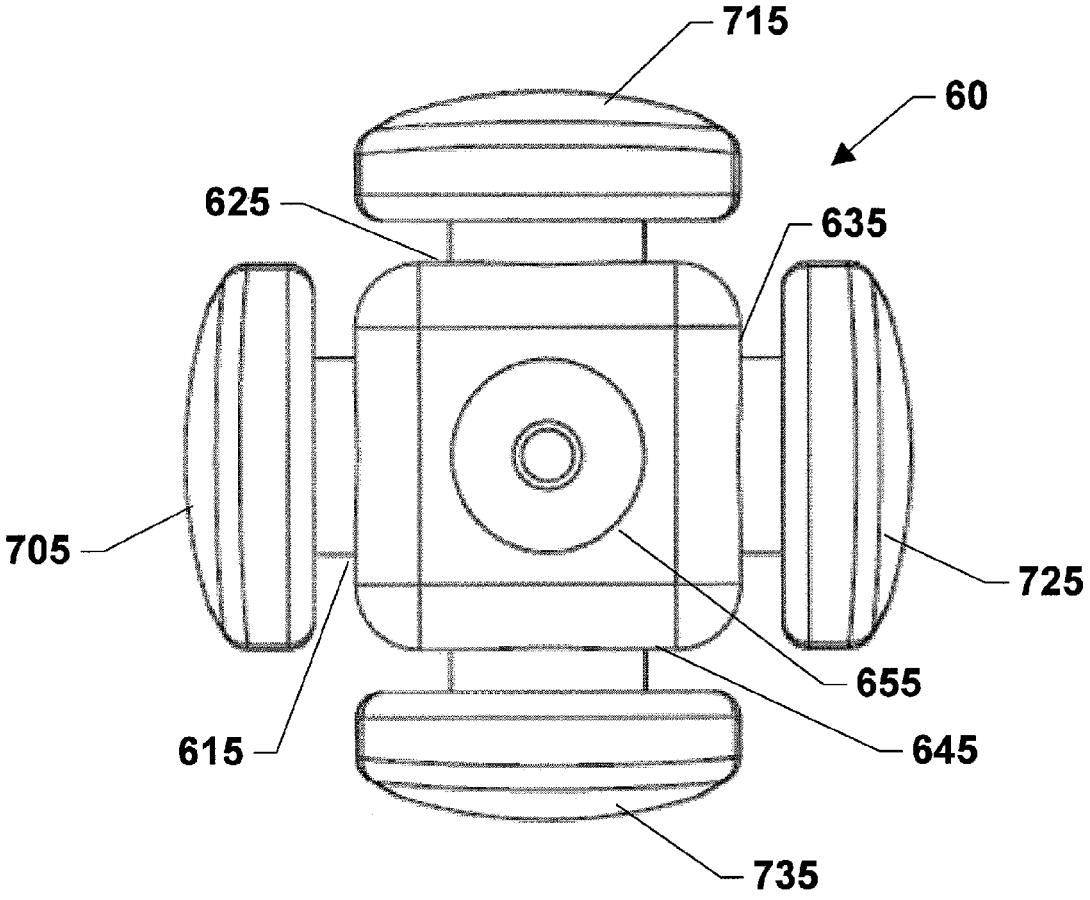
Figure 20:
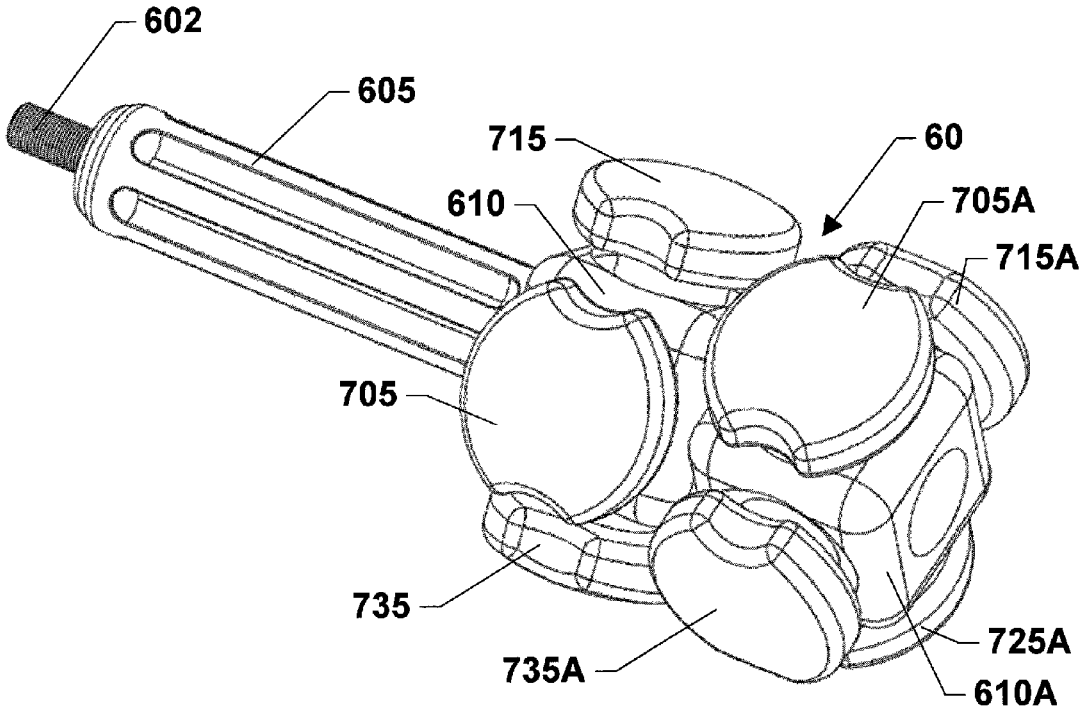
Figure 21:
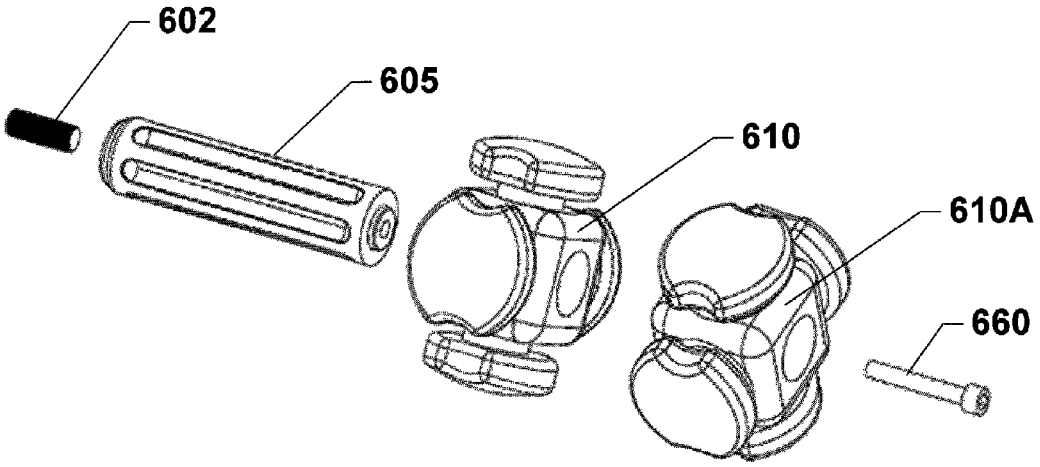

Having thus described various embodiments in general terms, reference will now be made to the accompanying drawings, which are not necessarily drawn to scale, and wherein:

FIG. 1 is a first perspective view of a bow stabilizing and shock dampening assembly according to a particular embodiment;

FIG. 2 is a second perspective view of the bow stabilizing and shock dampening assembly of FIG. 1;

FIG. 3 is a top view of the bow stabilizing and shock dampening assembly of FIG. 1;

FIG. 4 is an end view of the bow stabilizing and shock dampening assembly of FIG. 1;

FIGS. 5-6 are perspective cross sectional views of the bow stabilizing and shock dampening assembly of FIG. 1;

FIGS. 7A-7C are perspective views of substantially planar dampeners according to various embodiments;

FIG. 8 is a side view of the bow stabilizing and shock dampening assembly of FIG. 1 installed on a bow;

FIG. 9 is a perspective view of a bow stabilizing and shock dampening assembly according to another embodiment;

FIG. 10 is a perspective view of a bow stabilizing and shock dampening assembly according to a further embodiment;

FIG. 11 is a cross-sectional perspective view of the bow stabilizing and shock dampening assembly of FIG. 10;

FIG. 12 is a perspective view of a bow stabilizing and shock dampening assembly according to a particular embodiment;

FIG. 13 is a perspective view of the bow stabilizing and shock dampening assembly of FIG. 12;

FIG. 14 is a perspective cross-sectional view of the bow stabilizing and shock dampening assembly of FIG. 12;

FIG. 15 is an exploded perspective view of the bow stabilizing and shock dampening assembly of FIG. 12;

FIG. 16 is a perspective view of a bow stabilizing and shock dampening assembly according to a particular embodiment;

FIG. 17 is a side view of the bow stabilizing and shock dampening assembly of FIG. 12 installed on a bow;

FIG. 18 is a perspective view of a bow stabilizing and shock dampening assembly according to a further embodiment;

FIG. 19 is an end view of the bow stabilizing and shock dampening assembly of FIG. 18;

FIG. 20 is a perspective view of a bow stabilizing and shock dampening assembly according to a further embodiment; and FIG. 21 is an exploded view of the bow stabilizing and shock dampening assembly of FIG. 20.

DETAILED DESCRIPTION

Various embodiments of the present invention will now be described more fully hereinafter with reference to the accompanying drawings, in which various embodiments are shown. The invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

A bow stabilizing and shock dampening assembly 10 according to a particular embodiment is shown in FIG. 1. As may be understood from this figure, the bow stabilizing and shock dampening assembly 10 comprises an elongated housing 100, and an attachment mechanism 102 that extends from a proximal end of the housing 100. The attachment mechanism 102 is adapted for attaching (e.g., selectively attaching) the bow stabilizing and shock dampening assembly 10 to a bow 12 as shown, for example, in FIG. 8. In particular embodiments, the attachment mechanism 102 is a threaded rod. However, in other embodiments, the attachment mechanism 102 may be any other suitable mechanism for attaching the bow stabilizing and shock dampening assembly 10 to the bow 12.

As may be understood from FIG. 1, the elongated housing 100 is a substantially cylindrical structure that comprises: (1) a base portion 105; (2) a first dampener support 115 that is spaced a first distance apart from the base portion 105; (3) a second dampener support 125 that is spaced a second distance apart from the base portion 105; (4) a third dampener support 135 that is spaced a third distance apart from the base portion 105; and (5) a fourth dampener support 145 that is spaced a fourth distance apart from the base portion 105.

In various embodiments, the base portion 105 and each of the first, second, third, and fourth dampener supports 115, 125, 135, 145 are hollow rings, the centers of which are substantially co-linear. For example, in the embodiment shown in FIG. 1, the centers of the first, second, third, and fourth dampener supports 115, 125, 135, 145 are all disposed on a central axis of both the bow stabilizing and shock dampening assembly 10 and the elongated housing 100. In particular embodiments, such as the embodiment of FIG. 1: (1) the distance between the third dampener support 135 and the fourth dampener support 145 is greater than (e.g., at least 20% greater than) the distance between the second dampener support 125 and the third dampener support 135; (2) the distance between the second dampener support 125 and the third dampener support 135 is greater than (e.g., at least 20% greater than) the distance between the first dampener support 115 and the second dampener support 125; and (3) the distance between the first dampener support 115 and the second dampener support 125 is greater than (e.g., at least 20% greater than) the distance between the base 105 of the elongated housing 100 and the first dampener support 115. In other embodiments, however, the dampener supports 115, 125, 135, 145 may be substantially evenly spaced apart and/or may be spaced apart in any other suitable arrangement.

In particular embodiments: (1) the base 105 of the elongated housing 100 is connected to the first dampener support 115 by a first connection portion 110: (2) the first dampener support 115 is connected to the second dampener support 125 by a second connection portion 120; (3) the second dampener support 125 is connected to the third dampener support 135 by a third connection portion 130; and (4) the third dampener support 135 is connected to the fourth dampener support 145 by a fourth connection portion 140.

As may be understood from FIGS. 1-6, in particular embodiments, the first, second, third, and fourth connection portions 110, 120, 130, 140 each comprise a plurality of (e.g., three) elongated connection members that are substantially parallel to the central axis of the elongated housing 100, and to each other. In the embodiment shown in FIG. 1, the three elongated connection members are spaced evenly apart about the outer circumference of the housing 10. In this embodiment, the elongated housing 10 defines an opening between each adjacent pair of connection members. As discussed in greater detail below, each of these openings is dimensioned to allow a user to pass a dampener 205, 215, 225, 235 from outside the housing 100, through the opening, and into the housing's interior 100.

As may be understood from FIG. 5, in particular embodiments, each of the first, second, third, and fourth dampener supports 115, 125, 135, and 145 is substantially in the form a hollow ring and defines a groove 117, 127, 137, 147 adjacent its interior surface. As discussed further below, each of these grooves 117, 127, 137, 147 is adapted to receive a portion of a respective dampener 205, 215, 225, 235, which serves to hold the dampener 205, 215, 225, 235 in place relative to the elongated housing 100.

In particular embodiments, the elongated housing 100 defines a substantially circular opening in the housing's distal end. As shown in FIGS. 5 and 6, this allows dampeners of different lengths to be supported by the fourth dampener support 145.

In various embodiments, the housing 100 is an elongated piece of metal that is generally in the form of a hollow cylinder. The hollow cylinder defines a plurality of cutouts in its sides and distal end. In other embodiments, the housing 100 may be made of one or more pieces of any other suitable material or combination of materials. For example, in particular embodiments, the respective dampener supports 115, 125, 135, 145 may be spaced apart and connected by lengths of a flexible material, such as rubber.

FIGS. 7A-7C depict dampeners 205, 205A, 205B according to three different embodiments. The dampener 205 of FIG. 7A comprises: (1) a rigid, substantially cylindrical central portion 206 (which may be made, for example, of metal or plastic); (2) a hollow cylindrical flexible outer portion 207 (which may be made of any suitable flexible material, such as rubber); and (3) a thin, ring-shaped outer lip 208 that extends about the circumference of the outer portion 207. In particular embodiments, the thickness of the lip 208 is about the same as the thickness of the respective grooves 117, 127, 137, 147 of the various dampener supports 115, 125, 135, 145. In a particular embodiment, the respective centers of the central portion 206, outer portion 207, and outer lip 208 are all substantially collinear and the dampener 205 is substantially symmetrical about its central axis.

The dampener 205A of FIG. 7B comprises a rigid, substantially cylindrical central portion 206A (which may be made, for example, of metal or plastic), and a hollow cylindrical flexible outer portion 207A (which may be made of any suitable flexible material, such as rubber). In particular embodiments, the thickness of the flexible outer portion 207A is about the same as the thickness of the respective grooves 117, 127, 137, 147 of the various dampener supports 115, 125, 135, 145.

The dampener 205B of FIG. 7C comprises a rigid, substantially spherical central portion 206B (which may be made, for example, of metal or plastic), and a hollow cylindrical flexible outer portion 207B (which may be made of any suitable flexible material, such as rubber). In particular embodiments, the thickness of the flexible outer portion 207B is about the same as the thickness of the respective grooves 117, 127, 137, 147 of the various dampener supports 115, 125, 135, 145.

Exemplary Use of Bow Stabilizer Assemblies

To use a bow stabilizing and shock dampening assembly 10 according to various embodiments, a user first positions one or more dampeners 205, 215, 225, 235 in place within the bow stabilizing and shock dampening assembly's elongated housing 100. For example, when using the bow stabilizing and shock dampening assembly 10 shown in FIGS. 1-5, a user: (1) positions the first dampener 205 in the bow stabilizing and shock dampening assembly's first dampener support 115; (2) positions the second dampener 215 in the bow stabilizing and shock dampening assembly's second dampener support 125; (3) positions the third dampener 225 in the bow stabilizing and shock dampening assembly's third dampener support 135; and (4) positions the fourth dampener 235 in the bow stabilizing and shock dampening assembly's fourth dampener support 145.

In this example, the first, second, and third dampeners 205, 215, 225 all have a structure that is similar to the dampener 205 shown in FIG. 7A. The fourth dampener 235 has a structure that is generally similar to the first, second, and third dampeners 205, 215, 225, except that the fourth dampener 235 has a center portion that is longer and heavier than the center portion of the first, second and third dampeners 205, 215, 225. This causes the fourth dampener 235 to be heavier than the first, second and third dampeners 205, 215, 225.

In the embodiment of FIGS. 1-5, a user may insert any of the various dampeners 205, 215, 225, 235 in place within the elongated housing 100 by: (1) squeezing the dampener 205, 215, 225, 235, which compresses the dampener's flexible outer portion and temporarily reduces the dampener's width; (2) inserting the dampener 205, 215, 225, 235 into the housing's interior through any suitable opening in the housing 100; (3) orienting the dampener 205, 215, 225, 235 so that it is positioned within a plane that is generally parallel to the sides of the housing 100; (3) while the dampener 205, 215, 225, 235 is in this orientation, moving the dampener 205, 215, 225, 235 toward the particular dampener support 115, 125, 135, 145 that will ultimately hold the dampener in place. The user then positions the dampener's circumferential outer lip 207, 217, 227, 237 within the groove 117, 127, 137, 147 defined by the particular dampener support 115, 125, 135, 145 until the outer lip 207, 217, 227, 237 snaps into place within the groove 117, 127, 137, 147 (and, in various embodiments, substantially matingly engages the interior portion of the dampener support 115, 125, 135, 145 that defines the groove 117, 127, 137, 147). In this configuration, the engagement between the dampener's outer lip 207, 217, 227, 237 and the dampener support 115, 125, 135, 145: (1) provides a flexible interface between the dampener 205, 215, 225, 235 and the dampener support 115, 125, 135, 145; and (2) maintains the dampener 205, 215, 225, 235 in a substantially fixed position and orientation while the dampener 205, 215, 225, 235 is installed on a bow, and while the bow is used to shoot an arrow.

To remove a dampener 205, 215, 225, 235 from the housing 100, a user may simply push the dampener 205, 215, 225, 235 out of engagement with the dampener support 115, 125, 135, 145, and then use their fingers to pull the dampener 205, 215, 225, 235 through a suitable opening in the housing 100.

As may be understood from the example above, in various embodiments, the bow stabilizing and shock dampening assembly 10 is adapted to allow users to, without tools, install dampeners 205, 215, 225, 235 into, and remove dampeners 205, 215, 225, 235 from, the bow stabilizing and shock dampening assembly's housing 100. This may, for example, allow users to quickly change the configuration of the bow stabilizing and shock dampening assembly 10.

For example, turning to FIG. 5, if a user wishes to move weight away from the end of the bow stabilizing and shock dampening assembly 10 and toward the middle of the assembly 10, a user may use the techniques described above to: (1) remove the third and fourth dampeners 225, 235 from the bow stabilizing and shock dampening assembly 10; (2) insert the fourth dampener 235 in the third dampener support 135; and (3) insert the third dampener 225 in the fourth dampener support 145. Similar techniques may be used to allow users to rearrange or remove the various dampeners (e.g., without tools) as desired. As an aside, it should be understood in light of the above that the bow stabilizing and shock dampening assembly 10 may be adapted for use without dampeners 205, 215, 225, 235 disposed in each of the bow stabilizing and shock dampening assembly's various dampener supports 115, 125, 135, 145.

Once the dampeners 205, 215, 225, 235 are in their desired positions within the bow stabilizer's housing 100, the user may attach the bow stabilizing and shock dampening assembly 10 to a bow (e.g., by screwing a threaded distal end of the bow stabilizing and shock dampening assembly's attachment mechanism 102 into a threaded recess in a front surface of the bow.) FIG. 8 shows a particular example in which the bow stabilizing and shock dampening assembly 10 is installed adjacent a front surface of a bow 12. The user then uses the bow 12 in the traditional manner to shoot arrows.

As shown in FIG. 8, in particular embodiments, when the bow stabilizing and shock dampening assembly 10 is installed adjacent the bow 10: (1) the bow stabilizing and shock dampening assembly's various dampeners 205, 215, 225, 235 are substantially parallel to each other; (2) the respective centers of the bow stabilizing and shock dampening assembly's various dampeners 205, 215, 225, 235 are at least substantially co-linear (e.g., they are co-linear); (3) each of the dampeners 205, 215, 225, 235 is disposed within a plane that is substantially perpendicular to the plane of the bow 12; and (4) the dampeners 205, 215, 225, 235 engage the housing's dampener supports 115, 125, 135, 145 about at least a portion of the circumference (e.g., part, or the entire circumference) of the dampeners 205, 215, 225, 235.

Exemplary Design Variations

The bow stabilizer assemblies described above may be provided in a variety of different lengths and configurations, and with a variety of numbers of dampeners and/or dampener supports. For example, the embodiment shown in FIG. 9 includes two dampener supports 105A, 125A that collectively support two different dampeners 205, 235.

As another example, the alternative embodiment of FIG. 10 includes a hollow flexible (e.g., rubber) housing 300 that defines a series of circumferential grooves that extend around the side portions of the housing as shown in FIGS. 10 and 11. The housing 300 defines a single dampener support 345 adjacent the distal end of the housing 300 for supporting a dampener 205A in the manner described above. In various embodiments, the distal end of the housing 300 is flared as shown in FIG. 10.

This bow stabilizing and shock dampening assembly 30 may be installed adjacent a bow (e.g., in the same general manner shown in FIG. 8) so that the bow stabilizing and shock dampening assembly's dampener is disposed within a plane that is substantially perpendicular to the plane of the bow. Also, in particular embodiments, the housing is adapted so that the dampener may be selectively removed from, or installed in, the housing 300 without tools.

Additional Embodiments

A bow stabilizing and shock dampening assembly 40 according to an additional embodiment is shown in FIGS. 12-15. As may be understood from these figures, this bow stabilizing and shock dampening assembly 40 comprises: (1) an attachment mechanism 402; (2) a first dampener support 415; (3) a second dampener support 425; (3) a third dampener support 435; and (4) a support structure that is adapted to support the first, second, and third dampener supports. In the embodiment shown in FIG. 12, the support structure includes a first connection portion 410 and a second connection portion 420. However, in other embodiments, the support structure may be in any other suitable form. The bow stabilizing and shock dampening assembly's attachment mechanism 402 is adapted for attaching (e.g., selectively attaching) the bow stabilizing and shock dampening assembly 40 to a bow (e.g. in the manner shown in FIG. 17) and may comprise, for example, any of the attachment mechanism embodiments described above.

As may be understood from FIGS. 12-15, the first, second, and third dampener supports 415, 425, 435 may be, for example, structurally similar to any of the dampener supports discussed above, and may be adapted to support any of a variety of suitable dampeners, such as dampeners 205B, 215B, and 235B, which are shown in FIG. 12. In view of the discussion above, it should be understood that, due to the various structural properties of the dampeners 205B, 215B, and 235B and the dampener supports 415, 425, 435, in various embodiments, a user may selectively install the dampeners 205B, 215B, and 235B into the dampener supports 415, 425, 435 without tools. Similarly, in various embodiments, a user may selectively remove the dampeners 205B, 215B, and 235B from the dampener supports 415, 425, 435 without tools. In other embodiments, tools may be required to install and/or remove the dampeners 205B, 215B, and 235B.

As will be discussed in greater detail below, in various embodiments, the first dampener support 415 is adapted to maintain the first dampener 205B in a first plane, the second dampener support 425 is adapted to maintain the second dampener 235B in a second plane, and the third dampener support 435 is adapted to maintain the third dampener 215B in a third plane (e.g., in the manner described above in regard to various other embodiments).

In various embodiments, the support structure supports the first, second, and third dampener supports 415, 425, 435 and maintains the first, second, and third dampener supports 415, 425, 435 in a substantially fixed relationship to each other. As shown in FIGS. 12-15, in the embodiment shown in these figures, the support structure connects the first, second, and third dampener supports 415, 425, 435 together.

In various embodiments, the first, second, and third dampener supports 415, 425, 435 collectively maintain the first, second, and third dampeners 205B, 215B, and 235B in planes that intersect each other (e.g., the first, second, and third planes are not parallel).

As shown in FIG. 12, the first plane (in which the first dampener 205B is disposed) intersects the second plane (in which the second dampener 235B is disposed). In particular embodiments, the angle of intersection between the first plane and the second plane may be any angle between about 15° and about 90° (e.g. about 30°, about 45°, about 60°, about 90°, or any other suitable angle). Similarly, in various embodiments, the angle of intersection between the second plane and the third plane may be any angle between about 15° and about 90° (e.g. about 30°, about 45°, about 60°, about 90°, or any other suitable angle). By the same token, in certain embodiments, the angle of intersection between the third plane and the first plane may be any angle between about 15° and about 90° (e.g. about 30°, about 45°, about 60°, about 90°, or any other suitable angle).

In various embodiments, such as the embodiment shown in FIGS. 12-15, a line of intersection between the first and second planes may be substantially parallel to: (1) a line of intersection between the second and third planes; and/or (2) a line of intersection between the first and third planes. In the embodiment of FIGS. 12-15, the first, second and third planes form an equilateral triangular prism where the angle of intersection between the planes is about 60°). In alternative embodiments, the angle of intersection between the planes may be any other suitable angle between, for example, about 15° and about 90° (e.g. about 30°, about 45°, about 60°, or about 90°, or any other suitable angle).

As may be seen in FIGS. 12-15, in particular embodiments, the first, second, and third planes are substantially uniformly distributed (e.g., substantially evenly spaced apart) about a central axis of the support structure 400. For example, the dampener supports 410, 412, 414 form a perimeter about the central axis of the support structure and/or the central axis of the bow stabilizing and shock dampening assembly 40. In such an embodiment, the dampener supports 410, 412, 414 at least substantially surround (e.g., the dampener supports 410, 412, 414 may surround) the central axis of the support structure and/or the central axis of the bow stabilizing and shock dampening assembly 40.

In the embodiment shown in these FIGS. 12-15, each of the first, second, and third dampener supports 415, 425, 435 is adapted to maintain a respective dampener 205B, 215B, 235B in a plane that is at least substantially parallel to: (1) a central axis of the support structure; (2) the central axis of the bow stabilizing and shock dampening assembly 40, and/or (3) the central axis of the attachment mechanism 402. In this embodiment, the bow stabilizing and shock dampening assembly 40 is adapted so that, when the bow stabilizing and shock dampening assembly 40 is attached, via the attachment mechanism 402, to a bow as shown in FIG. 17: (1) the first and second planes intersect to form a line that is substantially parallel to the bow's cable rod 17; (2) the second and third planes intersect to form a line that is substantially parallel to the bow's cable rod 17; and (3) the third and first planes intersect to form a line that is substantially parallel to the bow's cable rod 17.

In particular embodiments, the first, second, and third planes may form an orthogonal system. Also, in some embodiments, the angles of intersection may also be different within the system (e.g., the angle of intersection between the first and second plane may be different than the angle of intersection between the first and third plane).

It should also be understood that different types of dampeners may be used in different embodiments. For example, the dampeners 505, 515, and 525 shown in FIG. 16 are somewhat larger than the dampeners 205B, 215B, and 235B shown in the embodiment of FIGS. 12-15.

In particular embodiments, the bow stabilizing and shock dampening assembly 40 may further comprise a fourth dampener support 445 (which is shown in FIGS. 12-15 not supporting a dampener). The fourth dampener support 445 may be disposed, for example, adjacent a distal end of the support structure 400.

FIGS. 18-19 depict an alternative embodiment of the assembly described generally above in which the assembly 60 includes four dampeners 705, 715, 725, 735 that are spaced evenly apart about the central axis of the assembly's support structure 610. In particular, this embodiment comprises: (1) an attachment mechanism 602; (2) a base portion 605; (3) a first dampener support 615; (4) a second dampener support 625; (5) a third dampener support 635; (6) a fourth dampener support 645; (7) a fifth dampener support 655; and (8) a support structure 610 that is adapted to support the first, second, third, fourth, and fifth dampener supports 615, 625, 635, 645, 655. In this embodiment, the first, second, third, and fourth dampener supports 615, 625, 635, 645 are adapted to maintain the first, second, third, and fourth dampeners 705, 715, 725, 735 in respective planes that cooperate to form a cuboid that surrounds a central axis of the bow stabilizing and dampening assembly 60.

A user may use the embodiment shown FIGS. 18 and 19 in much the same way as the other embodiments described herein.

FIGS. 20-21 depict a further embodiment that comprises the bow stabilizing and dampening assembly 60 of FIGS. 18-19 in combination with a second support structure 610A, which is disposed adjacent a distal end of the assembly's first support structure 610. In particular embodiments, this second support structure 610A is substantially identical to the first support structure 610 and the first and second support structures 610, 610A are attached to the base portion 605 by a fastener (e.g., a threaded bolt) that extends through each of the first and second support structures 610, 610A adjacent the central axes of the support structures 610, 610A.

The second support structure 610A is adapted to support additional first, second, third, fourth, and fifth dampener supports. As shown in FIGS. 20-21, the additional first, second, third, and fourth dampener supports are adapted to maintain additional first, second, third, and fourth dampeners 705A, 715A, 725A, 735A in respective planes that cooperate to form a cuboid that surrounds the central axis of the bow stabilizing and dampening assembly 60.

In additional embodiments, the first and second support structures 610, 610A are substantially identical support modules that are adapted to cooperate to form a support module assembly. In these embodiments, the bow stabilizing and dampening assembly 60 may comprise: (1) an attachment mechanism 602 that is adapted to attach the assembly to a bow; (2) a support module assembly that includes a plurality of support structures 610, 610A (e.g., two, three, four, or five support structures) that are each adapted to support one or more dampeners as described above; and (3) a base portion 605 that extends between the attachment mechanism 602 and the support module assembly. The support structures 610, 610A may be attached adjacent one another to form a substantially linear support module assembly.

In various embodiments, within the support module assembly, the support structures 610, 610A may be selectively rotated relative to one another and/or relative to the base portion 605 (e.g., by loosening the fastener 660 and rotating one or more of the support structures 610, 610A into the desired orientation). Once the support structures 610, 610A are in the desired position, the support structures 610, 610A may be fixed in place by selectively tightening the fastener 660.

In various embodiments, the support structures 610, 610A may be adapted to support any number of dampeners (e.g., one, two, three, four, or five dampeners). The support structures 610, 610A may be any shape (e.g., in the form of a cylinder, prism, cube, or any other suitable shape) and may support the dampeners in a substantially uniform arrangement or in a non-uniform arrangement.

A user may use the embodiment shown in FIGS. 20 and 21 in much the same way as the other embodiments described herein. In particular embodiments, the first and second support structures 610, 610A may be selectively rotated relative to one another (e.g., about the central axis of the bow stabilizing and dampening assembly 60). In particular embodiments, an angle between the first dampener 705 of the first support structure 610 and the first dampener 705A of the second support structure 610A may be selectively adjusted by a user. In particular embodiments, the angle between these respective first dampeners 705, 705A may be selectively adjusted by a user to any angle between 0° and 360° (e.g., 10°, 15°, 30°, or 45°).

As noted above, in various embodiments, a fastener 660 (e.g., a threaded screw or bolt) may be used to selectively prevent the first and second support structures 610, 610A from rotating relative to one another and to selectively fix the angle between the support structures' respective first dampeners 705, 705A. In particular embodiments, the base portion 605 may be adapted to store any excess length of the fastener 660 when a particular module is removed from the module assembly (e.g., when one of the plurality of modules is removed, the end portion of the fastener 660 may extend into a cavity defined by the base portion 605).

CONCLUSION

Many modifications and other embodiments of the invention will come to mind to one skilled in the art to which this invention pertains having the benefit of the teachings presented in the foregoing descriptions and the associated drawings. For example, while the dampeners described above are described as being generally circular, other shapes and sizes of dampeners (and dampener supports) may be used in other embodiments. Also, it should be understood that the techniques and structures described above could be used in contexts other than archery. For example, the stabilizing and dampening systems described herein may be attached to other types of weapons (e.g., firearms) to facilitate a more comfortable and accurate use of those weapons. Therefore, it is to be understood that the invention is not to be limited to the specific embodiments disclosed and that modifications and other embodiments are intended to be included within the scope of the appended exemplary concepts. Although specific terms are employed herein, they are used in a generic and descriptive sense only and not for the purposes of limitation.

What is claimed is:

1. A bow stabilizing and shock dampening assembly comprising:
- a dampener support;
- a support structure for supporting said dampener support; and
- an attachment mechanism that is adapted for selectively attaching said bow stabilizing and shock dampening assembly to a bow, wherein:
  - said support structure extends between said dampener support and said attachment mechanism;
  - said dampener support is formed through a wall of the support structure; and
  - said dampener support is adapted to maintain a dampener in a plane that is at least substantially parallel to a central axis of said bow stabilizing and shock dampening assembly.

2. The bow stabilizing and shock dampening assembly of claim 1, wherein said dampener support is adapted to allow a user to selectively install said dampener into said dampener support without using a tool.

3. The bow stabilizing and shock dampening assembly of claim 2, wherein said dampener support is adapted to allow a user to selectively remove said dampener from said dampener support without using a tool.

4. The bow stabilizing and shock dampening assembly of claim 1, wherein:
- said dampener support is a first dampener support;
- said dampener is a first dampener;
- said plane is a first plane;
- said bow stabilizing and shock dampening assembly further comprises a second dampener support attached proximate said first dampener support; and
- said second dampener support is positioned and adapted to maintain a second dampener in a second plane that is at least substantially parallel to a central axis of said bow stabilizing and shock dampening assembly.

5. The bow stabilizing and shock dampening assembly of claim 4, wherein:

said bow stabilizing and shock dampening assembly is adapted so that, when said bow stabilizing and shock dampening assembly is attached, via said attachment mechanism, to a bow:

said first and second planes intersect to form a line that is substantially parallel to a cable rod of the bow.

6. The bow stabilizing and shock dampening assembly of claim 4, wherein:

said bow stabilizing and shock dampening assembly further comprises a third dampener support attached proximate said first and second dampener supports; and said third dampener support is positioned and adapted to maintain a third dampener in a third plane that is at least substantially parallel to a central axis of said bow stabilizing and shock dampening assembly.

7. The bow stabilizing and shock dampening assembly of claim 6, wherein:

said first, second and third dampener supports are adapted to support said first, second, and third dampeners so that said first, second, and third dampeners are spaced apart about said central axis of said bow stabilizing and shock dampening assembly.

8. The bow stabilizing and shock dampening assembly of claim 7, wherein said first, second and third planes cooperate to form a triangular prism.

9. The bow stabilizing and shock dampening assembly of claim 7, wherein:

said first, second and third dampeners substantially surround said central axis of said bow stabilizing and shock dampening assembly.

10. The bow stabilizing and shock dampening assembly of claim 7, wherein said first, second and third planes cooperate to form a triangular prism.

11. The bow stabilizing and shock dampening assembly of claim 5, wherein:

said bow stabilizing and shock dampening assembly further comprises a fourth dampener support; and said fourth dampener support is adapted to maintain a fourth dampener in a fourth plane that is at least substantially parallel to a central axis of said bow stabilizing and shock dampening assembly.

12. The bow stabilizing and shock dampening assembly of claim 11, wherein said first, second, third, and fourth planes cooperate to form a cuboid.

13. The bow stabilizing and shock dampening assembly of claim 12, wherein:

said first, second, third and fourth dampeners substantially surround said central axis of said bow stabilizing and shock dampening assembly.

14. A bow stabilizing and shock dampening assembly comprising:

a first dampener support that is adapted to maintain a first dampener in a first plane;

a second dampener support that is adapted to maintain a second dampener in a second plane;

a third dampener support that is adapted to maintain a third dampener in a third plane;

an attachment mechanism that is adapted for attaching said bow stabilizer assembly to a bow; and a support structure that is adapted for maintaining said first, second, and third dampener supports in a substantially fixed relationship relative to each other while said bow stabilizer is in use, wherein a line of intersection between said first and second planes is substantially parallel to:

(A) a line of intersection between said second and third planes; and (B) a line of intersection between said first and third planes; and an opening is formed through a wall of the support structure intermediate at least the first and the second dampener supports.

15. The bow stabilizing and shock dampening assembly of claim 14, further comprising:

a first dampener that is adapted to be supported by said first dampener support;

a second dampener adapted to be supported by said second dampener support;

a third dampener adapted to be supported by said third dampener support, wherein said first, second, and third dampener supports and said support structure are adapted to cooperate to maintain said first, second, and third dampeners in a substantially fixed spatial relationship to each other.

16. The bow stabilizer assembly of claim 15, wherein said first, second, and third dampeners are substantially circular.

17. The bow stabilizer of claim 15, wherein said first, second, and third dampener supports are substantially uniformly distributed about a central axis of said support structure.

18. The bow stabilizer of claim 15, further comprising a fourth dampener support that is adapted to maintain a fourth dampener in a fourth plane that is substantially perpendicular to said first plane.

19. The bow stabilizer of claim 18, wherein said fourth plane is substantially perpendicular to said second and third planes.

20. A weapon stabilizing and shock dampening assembly comprising:

a first dampener support that is adapted to maintain a first dampener in a first plane;

a second dampener support that is adapted to maintain a second dampener in a second plane, wherein said first and second planes are not substantially parallel to each other; and a fastening mechanism for selectively fastening said weapon stabilizing and shock dampening assembly to a weapon, wherein said first and said second dampener supports are coupled together by a first connection portion distal from said fastening mechanism and a second connection portion that is proximate to said fastening mechanism, and said first dampener support, said second dampener support, and first connection portion and said second connection portion together define an aperture intermediate said first and said second dampener supports.

21. The weapon stabilizing and shock dampening assembly of claim 20, wherein said first and second planes form an angle of greater than about 5 degrees.

22. The weapon stabilizing and shock dampening assembly of claim 21, further comprising a third dampener support that is adapted to maintain a third dampener in a third plane, wherein:

said third plane is not substantially parallel to said first plane; and said third plane is not substantially parallel to said second plane.

23. The weapon stabilizing and shock dampening assembly of claim 22, wherein said first, second, and third planes at least substantially form a triangular prism.

24. The weapon stabilizing and shock dampening assembly of claim 22, wherein:

said first dampener support is adapted to support said first dampener by engaging at least a portion of a circumference of said first dampener; and said second dampener support is adapted to support said second dampener by engaging at least a portion of a circumference of said second dampener.

25. The weapon stabilizing and shock dampening assembly of claim 24, wherein:

said first dampener comprises a substantially rigid central portion that is surrounded substantially entirely by a flexible outer portion.

26. The weapon stabilizing and shock dampening assembly of claim 20, wherein said weapon is a bow.

* * * * *